United States Patent [19]

Fette

[11] Patent Number: 4,707,858

[45] Date of Patent: Nov. 17, 1987

[54] EXTREMELY NARROWBAND COMMUNICATIONS SYSTEM UTILIZING WORD-TO-DIGITAL CONVERSION

[75] Inventor: Bruce A. Fette, Mesa, Ariz.

[73] Assignee: Motorola, Inc., Schaumburg, Ill.

[21] Appl. No.: 490,701

[22] Filed: May 2, 1983

[51] Int. Cl.[4] ..... G10L 5/00

[52] U.S. Cl. ..... 381/43; 381/39

[58] Field of Search ..... 381/29–53

[56] References Cited

U.S. PATENT DOCUMENTS

| | | | |
|---|---|---|---|
| 4,424,415 | 1/1984 | Lin | 381/50 |
| 4,473,904 | 9/1984 | Suekiro et al. | 381/36 |
| 4,556,944 | 12/1985 | Daniels et al. | 364/466 |
| 4,590,604 | 5/1986 | Feilchenfeld | 381/42 |

OTHER PUBLICATIONS

Wrench, Jr., "A Realtime Implementation of a Text Independent Speaker Recognition System", IEEE, 1981, pp. 193–196.

*Primary Examiner*—Gareth D. Shaw
*Assistant Examiner*—John G. Mills
*Attorney, Agent, or Firm*—Lowell W. Gresham; Eugene A. Parsons

[57] ABSTRACT

A communications system each end of which includes means for analyzing human speech and comparing each word to prestored words for word and speacker recognition, the message then being digitized along with characteristic properties of the speackers voice to form a signal for transmission having a rate of approximately 75 bits per second, transmitting the digitized message tc a remote terminal which converts it to a spoken message in the synthesized voice of the original speaker.

6 Claims, 8 Drawing Figures

A

```
ON
OFF
SAVE
SHUTUP
DISPLAY
HOW MANY
DELETE
INSERT
IDENTIFY
ZOOM
OVERLAY
SHIFTFOCUS
```

B

```
SHIFT FOCUS    LEFT
               RIGHT
               UP
               DOWN
               NORTH
               SOUTH
               EAST
               WEST
```

C

```
SHIFT FOCUS    SOUTH    0
                        1
                        2
                        3
                        4
                        5
                        6
                        7
                        8
                        9
                      POINT
```

D

```
SHIFT FOCUS    SOUTH    2    0
                            1
                            2
                            3
                            4
                            5
                            6
                            7
                            8
                            9
                          POINT
                          MILES
```

FIG. 8

EXTREMELY NARROWBAND COMMUNICATIONS SYSTEM UTILIZING WORD-TO-DIGITAL CONVERSION

BACKGROUND OF THE INVENTION

In communications systems it is highly desirable to communicate by voice messages. It is also desirable to utilize digital circuitry because much of the circuitry can be incorporated on a single intergrated circuit chip which greatly reduces the size and power required. However, digital representations of the human voice generally require a relatively wide bandwidth which eliminates the use of many types of transmission media, such as telephone lines and the like. Therefore, it is desirable to reduce the bit rate (bandwidth) of the messages as much as possible. The term "narrowband" traditionally refers to a bit rate of approximately 2400 bits per second. Prior art devices are above 300 bits per second and anything below 300 bits per second is referred to herein as "extremely narrowband".

SUMMARY OF THE INVENTION

The present invention pertains to an extremely narrowband communications system and method of communicating in an extremely narrowband wherein human speech is converted to electrical signals and analyzed to provide signals representative of properties which characterize the specific human speaking. The words of the message are then compared to words in storage so that the specific word is recognized and, if desirable, the specific speaker who uttered the word is recognized. A digital signal representative of the specific word, which may be ASCII or a numeric code, indicating the position of the word in storage, is combined with digital signals that characterize the human speaker's voice to form a message having a rate substantially less than 300 bits per second, which message is transmitted to a remote terminal. The remote terminal synthesizes the human voice so that the message sounds as though the original voice is speaking. A variety of methods and apparatus are utilized to insure the correct recognition of each word and the specific speaker including averaging LPC coefficients, postponing a decision as to the identity of the speaker when the comparison of the spoken to stored words lies within a predetermined area of uncertainty and modifying or updating the stored words of an individual speaker after the speaker is recognized.

It is an object of the present invention to provide a new and improved extremely narrowband communications system.

It is a further object of the present invention to provide a new and improved method of communicating by way of an extremely narrowband.

It is a further object of the present invention to provide an extremely narrowband communications system wherein a voice similar to that of the orignal speaker is synthesized at the receiving terminal.

It is a further object of the present invention to provide an extremely narrowband communications system wherein the recognition of speakers is extremely accurate.

These and other objects of this invention will become apparent to those skilled in the art upon consideration of the accompanying specification, claims and drawings.

BRIEF DESCRIPTION OF THE DRAWINGS

Referring to the drawings, wherein like characters indicate like parts throughout the figures;

FIG. 8 illustrates four typical displays combined with the flow chart of FIG. 7.

DESCRIPTION OF THE PREFERRED EMBODIMENT

Figure 1:
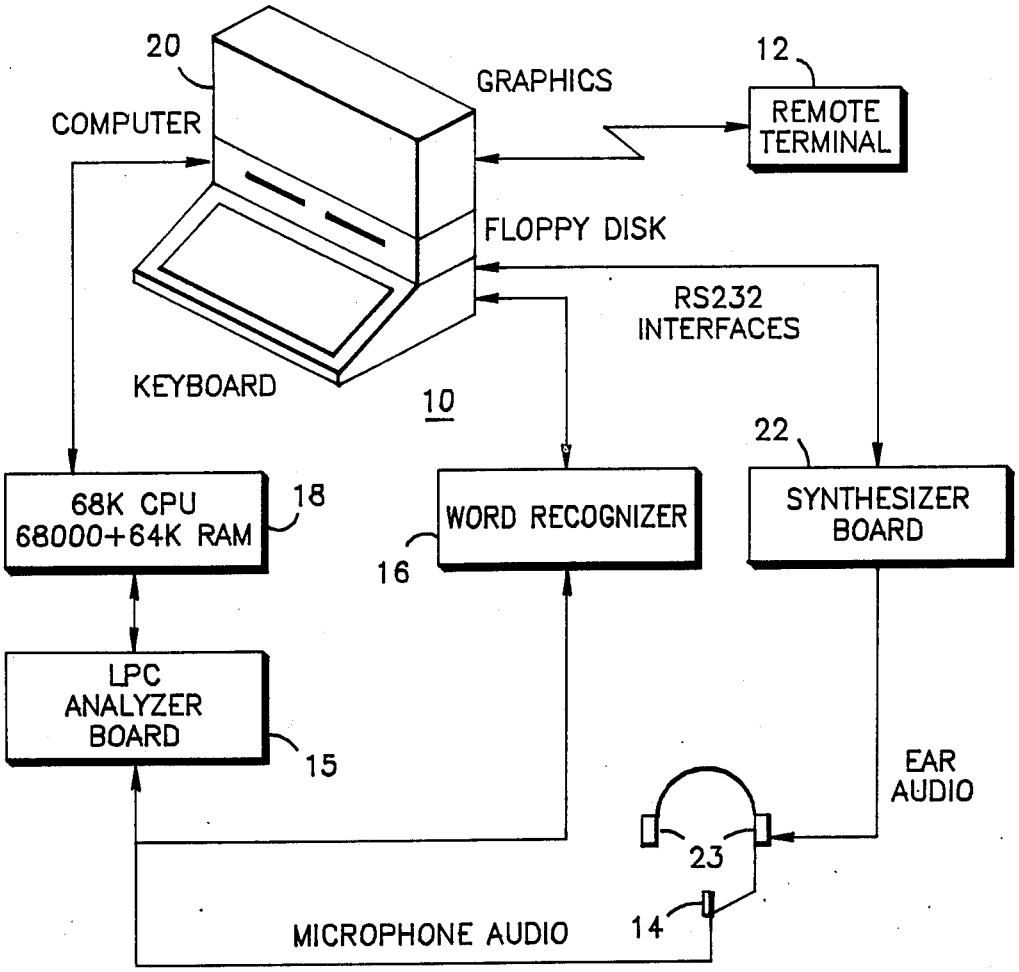
FIG. 1 is a simplified block diagram of an extremely narrowband communications system incorporating the present invention.

Referring specifically to FIG. 1 an extremely narrowband communications system embodying the present invention is illustrated. The communications system includes a local terminal, generally designated 10, and a remote terminal 12 connected to the local terminal 10 by some convenient means, such as telephone lines or the like. The local terminal 10 includes a microphone 14, for converting human speech to electrical signals in the usual fashion, connected to a linear predictive code (LPC) analyzer board 15 and a word recognizer 16. The analyzer board 15 is interconnected with a central processing unit (CPU) 18 which is in turn interconnected with a computer 20 having a key board, floppy disc memory and a visual display. The word recognizer 16 is interconnected with the personal computer 20 and a synthesizer board 22 is also interconnected with computer 20. The output of the synthesizer board 22 is connected to earphones 23, or some convenient form of transducer for converting electrical signals from the synthesizer board 22 into sound.

Figure 2:
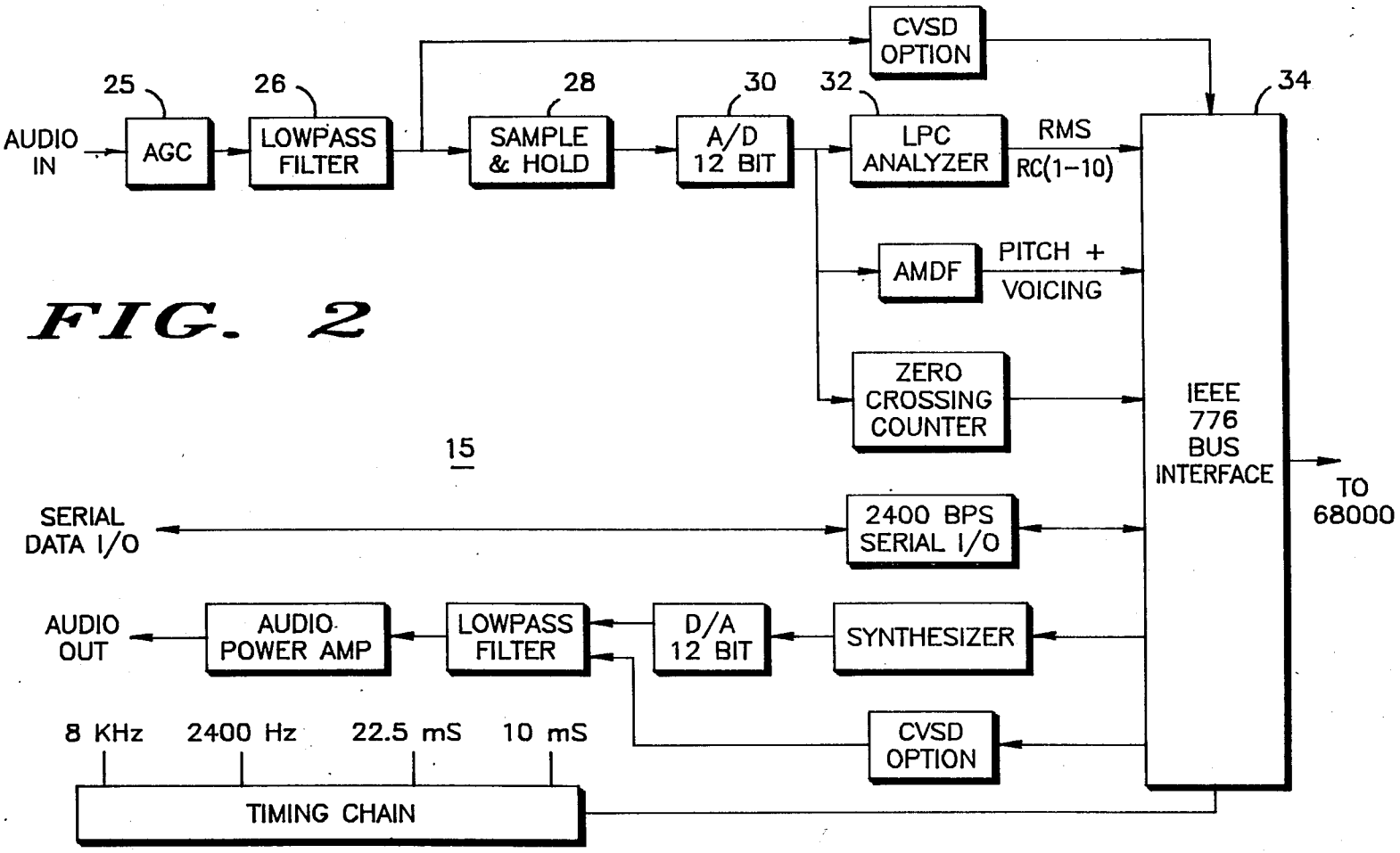
FIG. 2 is a block diagram of the LPC analyzer portion of the apparatus illustrated in FIG. 1.

FIG. 2 is a more detailed block diagram of the LPC analyzer board 15. The block diagram of FIG. 2 illustrates an entire digital voice processing system, as completely described in copending United States patent application entitled "Digital Voice Processing System", Ser. No. 309,640, filed Oct. 8, 1981. The LPC analyzer is only a portion of the system illustrated in FIG. 2 and is completely described in U.S. Pat. No. 4,378,469, issued Mar. 29, 1983, entitled "Human Voice Analyzing Apparatus". The entire processing system is illustrated because it is a portion of the analyzer board 15 and because the synthesizer portion of the board 15 may be utilized to synthesize the human voice so that it sounds like a speaker speaking into a remote terminal 12. In the present system the synthesizer of the board 15 is not utilized but it will be apparent to those skilled in the art that it could readily be incorporated in place of the synthesizer board 22.

Figure 3:
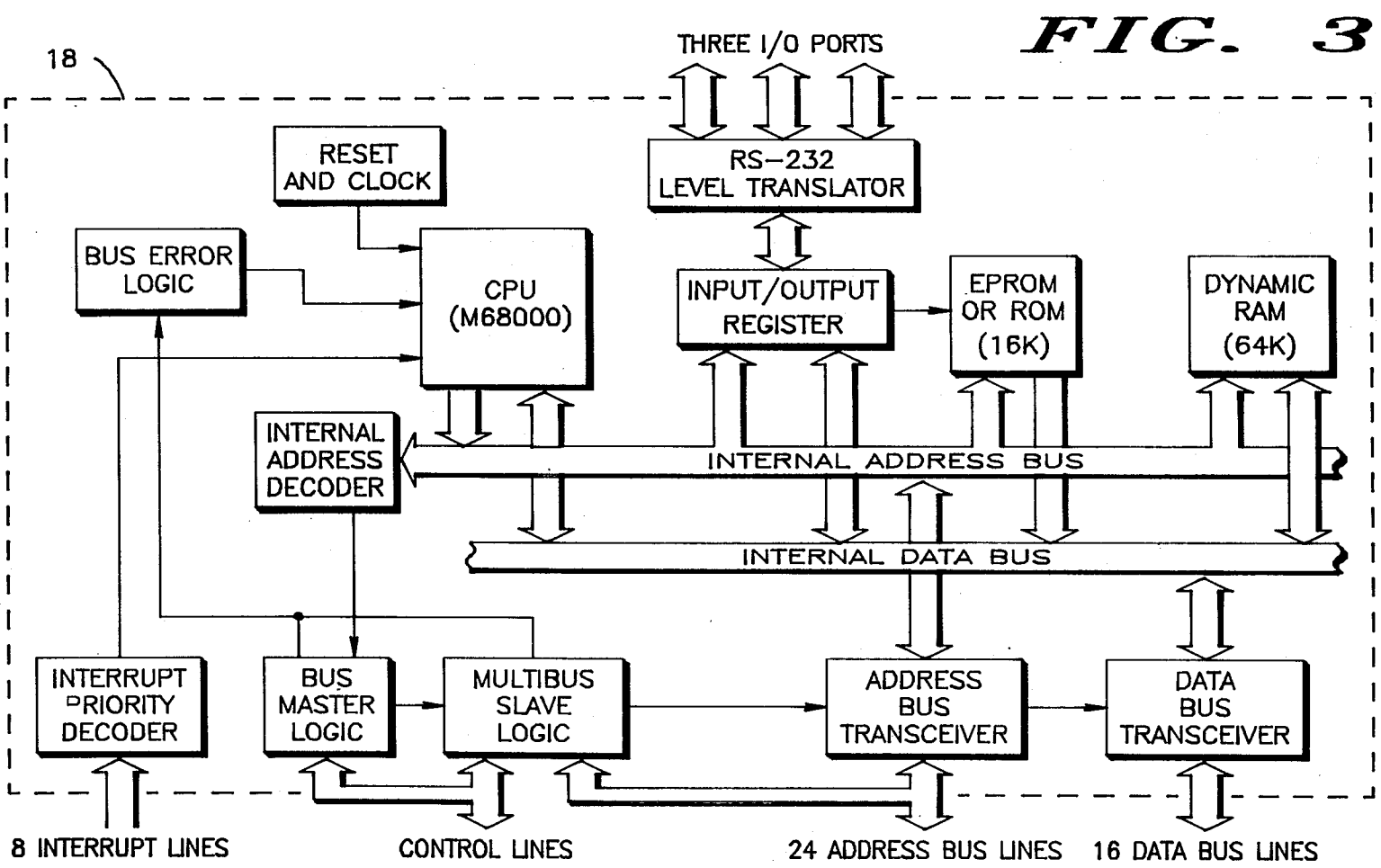
FIG. 3 is a block diagram of the CPU portion of the apparatus illustrated in FIG. 1.

Referring specifically to FIG. 2, the audio from the microphone 14 is supplied through an AGC network 25 and a low pass filter 26 to a sample and hold circuit 28. The sample and hold circuit 28 cooperates with an analog to digital converter 30 to provide 12 bit digital representations of each sample taken by the sample and hold circuit 28. The digital representations from the A/D converter 30 are supplied to an LPC analyzer 32 described in detail in the above referenced patent. The analyzer 32 supplies a plurality of signals representative of a plurality of properties which characterize a human voice, such as the range of pitch frequency and an estimate of the vocal track length, as well as optional additional properties such glottal exitation shape in the frequency domain and the degree of hoarseness, etc. The signals from the analyzer 32 also include an RMS value and a predetermined number (in this embodiment 10) of LPC coefficients. All of the signals from the analyzer 32 are supplied through an interface 34 to the CPU 18 for storage and processing. A more detailed block diagram of the CPU 18 is illustrated in FIG. 3, which in this embodiment is a commercially available CPU designated CMT 68K CPU. Because the CPU illustrated in FIG. 3 is a commercially available device the operation of which is well known to those skilled in the art, and because each of the blocks are well defined no specified description of the operation will be included herein.

Figure 4:
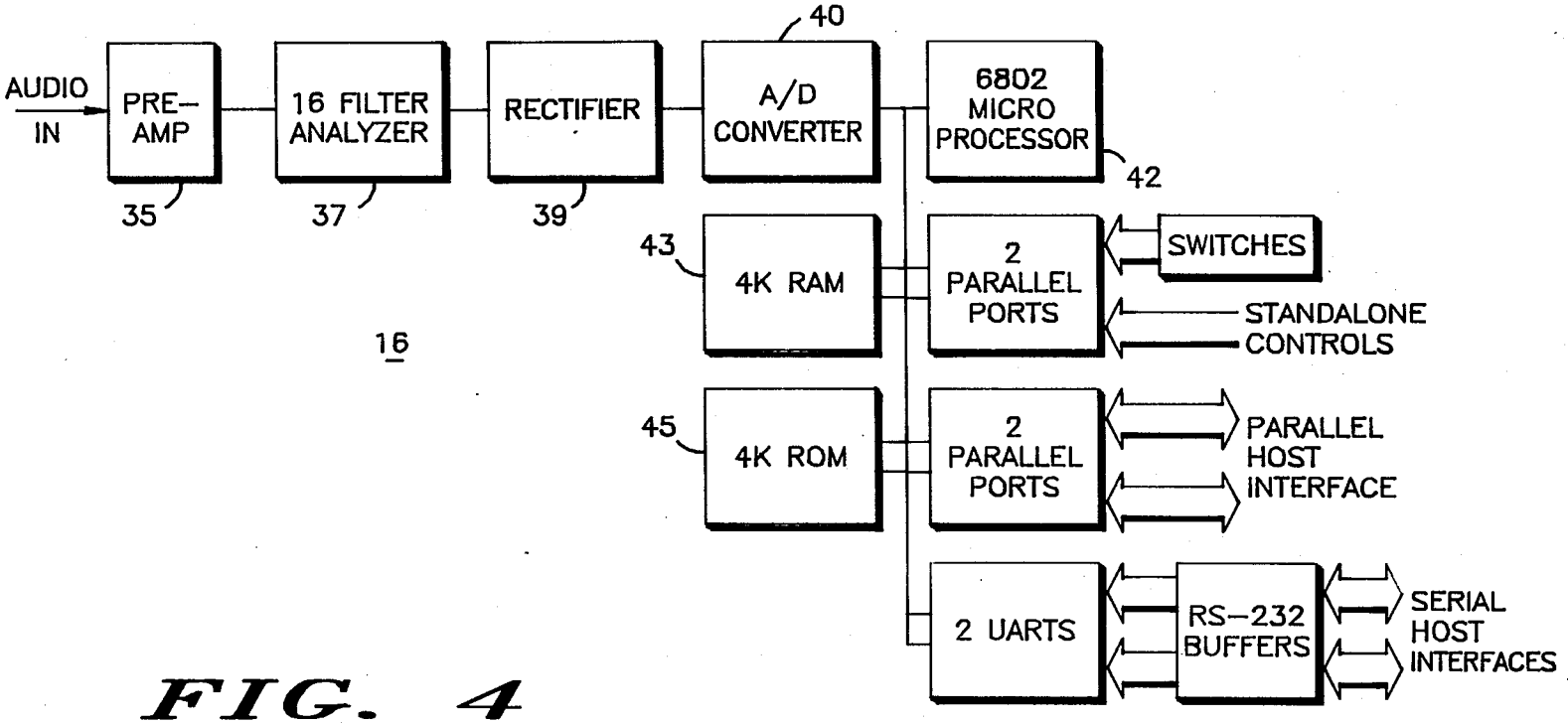
FIG. 4 is a block diagram of the word recognizer portion of the apparatus illustrated in FIG. 1.
Figure 5:
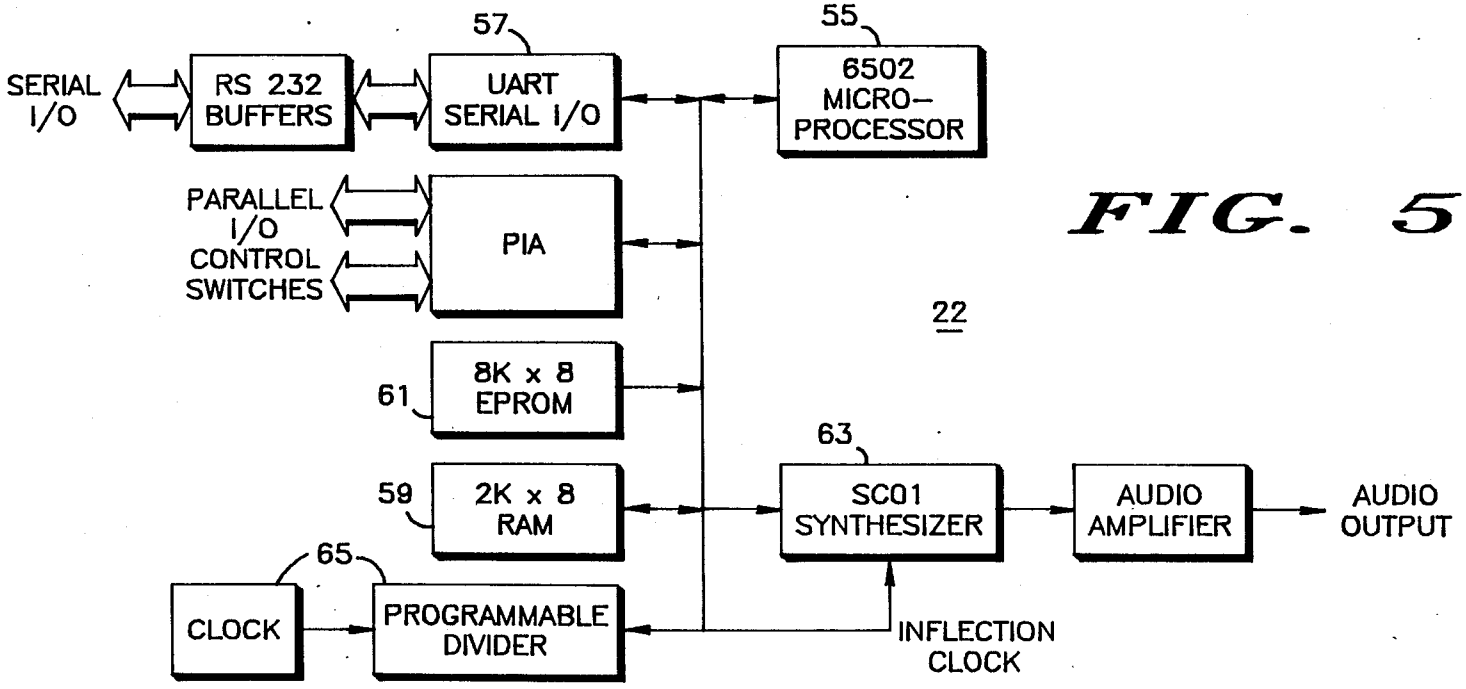
FIG. 5 is a block diagram of the synthesizer portion of the apparatus illustrated in FIG. 1.

While a variety of devices might be utilized for the word recognizer 16, in the present embodiment a commercially available item designated VRM102 is utilized and will be described in conjunction with FIG. 4. Referring specifically to FIG. 4, the audio from the microphone 14 is applied to the audio input and supplied through a preamplifier 35 to a 16 filter analyzer 37. The 16 filter analyzer 37 performs very basically the analyzing function of the board 15 and it will be clear to those skilled in the art that a word recognizer may also be based on signals from the LPC analyzer board 15. The output of analyzer 37 is supplied through a rectifier 39 to an 8 bit analog-to-digital converter 40. The converter 40 is interconnected with a 6802 microprocessor 42, a 4K RAM 43 and a 4K ROM 45. The word recognizer 16 also has several ports and buffers for communicating with the personal computer 20, the operation of which is clear and will not be discussed in detail herein.

Figure 6:
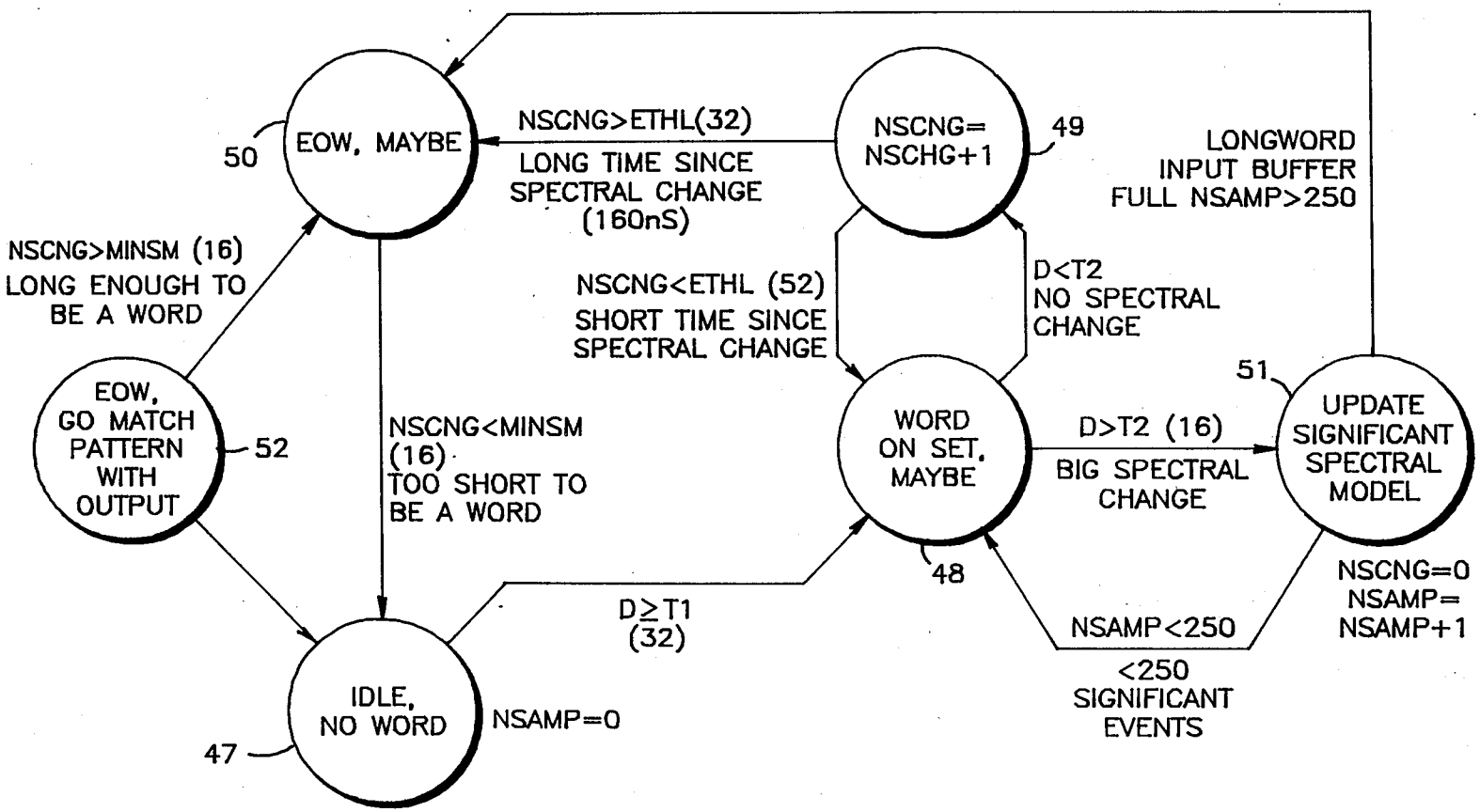
FIG. 6 is a flow chart illustrating the beginning and end of word identification in the word recognizer of FIG. 4.

Spectral amplitudes from the rectifier 39 are read every five milliseconds by the A/D converter 40. The system measures the spectral difference between the present spectrum and the background noise. When this difference exceeds a first threshold the system marks the possible onset of a word, and spectral samples are recorded in the "unknown" template memory, 4K RAM 43. At this point sensitivity to spectral change is increased, and new spectra are recorded whenever a small change, as measured against a second threshold, occurs between the present and last spectra. Each time a significant change occurs, a sample counter (NSAMP) located in the personal computer 20 is incremented. This count must reach a minimum of MINSAM (16 different spectral shapes before the system declares a valid word, otherwise the sound is determined to be background noise). Each five millisecond frame which does not exhibit a significant spectral change is a candidate for the end of the word. If 160 milliseconds pass with no change of spectrum, the last spectrum is declared likely to be the end of the word and pattern matching begins. A flow chart for this procedure is illustrated in FIG. 6.

The process begins with a state 47 labeled "idle, no word". The sample counter (NSAMP) begins with zero and when the difference between the present spectrum and the background noise extends threshold t1 the procedure moves to state 48 labeled "word onset, maybe". When the difference between the present and last spectra does not exceed the second threshold t2 the process moves to a circle 49 labeled "NSCNG=NSCHG+1". If the time since the last spectral change is short the process moves back to circle 48 to continue measuring spectral changes between the present and last spectra. If the time since the last spectral change is long (in this embodiment approximately 160 milliseconds the process moves to a state 50 labeled end of word (EOW, maybe). If the count in the sample counter is less then 16 the process moves back to circle 47 to start again and the spectral changes are considered too short to be a word and, therefore, must be background noise. If the count in the sample counter exceeds 16 the process moves to a state 52 labeled "EOW, go match pattern with output". In this case the system determines that a word was spoken and pattern matching begins.

Whenever the spectral change between the present and last spectra exceeds the threshold t2 the procedure moves to a state 51 labeled "update significant spectral model". If the input buffer of the sample counter NSAMP is not full, the procedure is shifted back to circle 48 for the next five millisecond sample. When the input buffer to the sample counter, NSAMP, becomes full on a big spectral change, the procedure moves directly to circle 50 where it is determined to be the end of a word and the procedure moves to circle 52 where pattern matching begins. If the input buffer of the sample counter, NSAMP, does not become full because of a small word there will eventually be no spectral changes in the samples and the process will move through the circle 49 path previously described.

In the present embodiment of the terminal, a predetermined number of speakers are authorized to use the terminal and models for predetermined words and phrases spoken by each speaker are stored in the floppy disc of the computer 20. The word recognizer 16 will be used to aid in speaker recogniztion in a somewhat simplified embodiment. As a specific speaker logs onto the system he identifies himself verbally by name, rank and serial number, or other identifying number. The beginning and end of each word is recognized by the word recognizer 16 which notifies the personal computer 20 of the word spoken. An electrical representation of LPC parametric data from the analyzer board 15 averaged over the voiced region of each word, then is matched in the CPU 18 to a stored model from the computer 20. The results of the matching are compared with a threshold to produce one vote as to the identity of the speaker.

As the user continues to use the system, the computer 20 recognizes places in sentences where the number of possible next words is relatively small, this will be explained in more detail presently. At these syntactic nodes, the personal computer 20 loads templates (stored models of words) from all speakers for these next possible words. When the next word is spoken the word recognizer recognizes that fact and compares the templates loaded into the system with the representation of the word just spoken. The recognizer then indicates the work spoken on the visual display of the computer 20 and the speaker. The computer 20 contains a vote counter for each of the possible authorized speakers. The counter of the indicated speaker is incremented with each word recognized to a maximum of 25 and the counters of all speakers not indicated are decremented to a lower limit of zero. When, for example, classified information is requested, these counters are checked and the identified speaker is the one with a count above 15, while all others must have counts below 8. If these criteria are not met, the classified information is denied. The system may request the user to speak random words continuing the identification algorithm until a clear winner with appropriate clearance is indicated, or it may continue normal usage, and at a later time the information may be requested again. The system can recognize a change of speaker within a maximum of ten words. Also, the speaker identification algorithm is generally transparent to the user and he is unaware that his voice is being analyzed during normal usage.

The verification subsystem software is down loaded from the floppy discs of the computer 20 and checksum tests verify the load. Next statistical models of each known speaker are also down loaded. While the unknown speaker speaks, long term statistics of the LPC reflection co-efficients are computed in real time over the last 30 seconds of speech. The statistics include average and standard deviation of the pitch and the first 10 reflection co-efficients. At the end of each word, as determined by the word recognizer 16, the CPU computes the Mehalanobis distance metric between the unknown and the model of each speaker. The Mehalanobis distance weights the distance by the ability of each measurement Eigenvector to differentiate the known speaker from the general population. Finally, the CPU reports the speaker with the best match and determines the accuracy of the estimate by the Mehalanobis distance ratioed by the standard deviation of that speaker and by ratio with the next closest match. Ambiguous results, i.e. when the match lies within a predetermined area of uncertainty, cause the system to postpone a decision, thus raising the accuracy. Finally, at the end of the usage session the speaker is given the option to update his voice model by the composite statistics of this usage session.

The LPC analyzer board 15 and CPU 18 also have a training mode which can gather these statistics of a given speaker and compute the Eigenvectors and values which model this speaker. The system can then upload this data for storage on the floppy discs of the computer 20. While the word recognizer 16 is illustrated as a separate unit of the system, it will be understood by those skilled in the art that it could easily be incorporated into the LPC analyzer board 15 and CPU 18 so that these units could perform the tasks of recognizing the start and stop of a word, recognizing the specific word and recognizing the speaker. In addition, templates or word models generally representative of each specific word to be recognized can be used in place of a word model for each word spoken by each speaker to be recognized, in which case only the specific words would be recognized by the apparatus and not each specific speaker.

Figure 7:
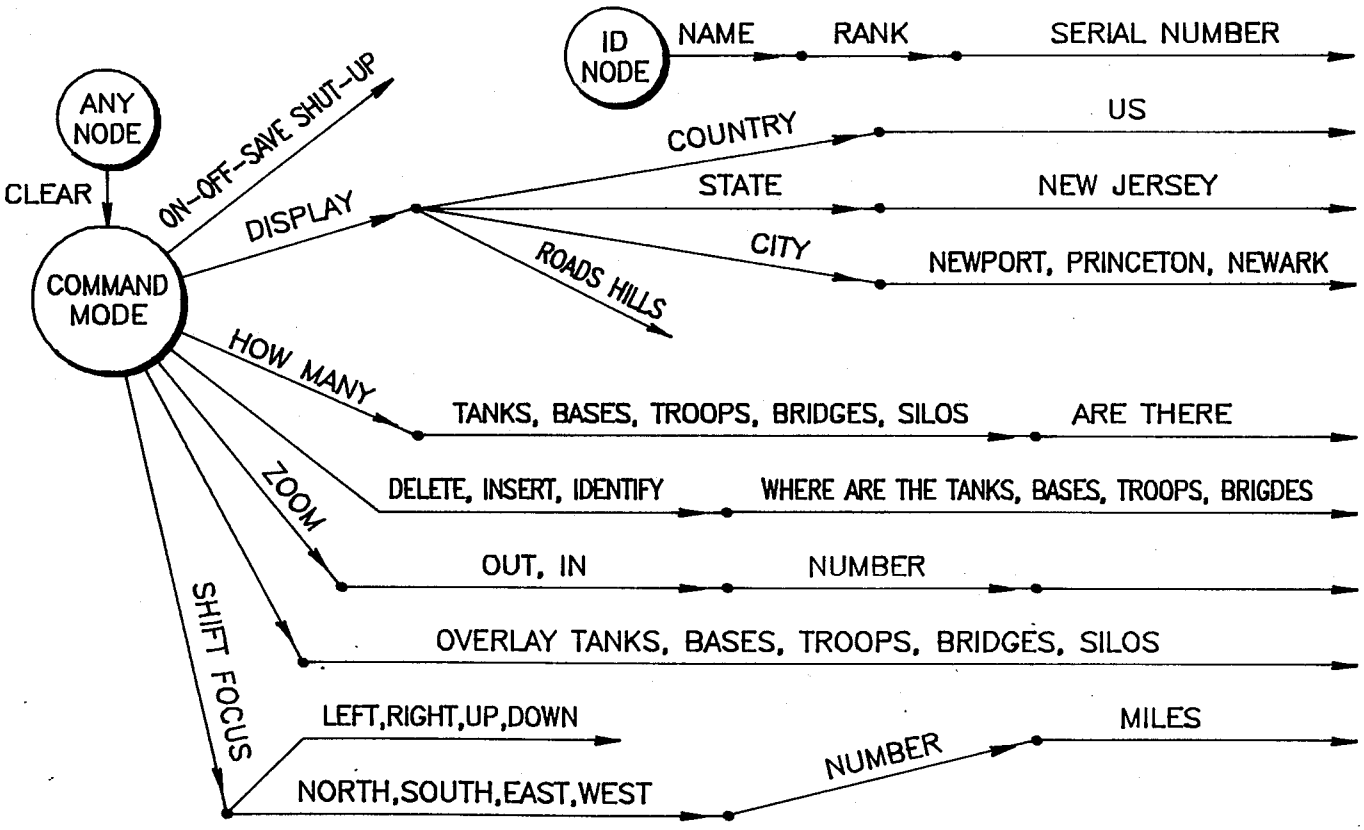
FIG. 7 illustrates a flow chart/syntax tree designed for a typical military usage.

A typical example of military usage of the present system is described in conjunction with FIGS. 7 and 8. In this specific embodiment the system is designed to involve the user in updating a geographical model of troops, support, and geographical environment. In the basic scenario for this embodiment the user requests information from the terminal and, if he is properly recognized and cleared, the information is supplied from some remote source. The assumption, for this specific example, is that the system is capable of providing pan left, right, up or down by half a screen; or north, south, east or west by n miles. It also provides the capability of zoom in and outward, and displays major geographical features such as (one of) country, state, city, boundaries, roads and hills. In this specific application the system contains 55 words and a syntax network with semantic associations to each node of the network, as illustrated in FIG. 7. A syntax network interactively guides selection of possible next words from all words known to the system, in the context of all sentences the system understands. At any time the speaker can say "clear" to being a sentence again, or can say "erase" to back up one word in the sentence. Words like "uh", "the", breath noise and "tongue clicks" are model words that are stored and intentionally ignored by the system. The system interactively aides the user as he speaks. When the system is expecting him to begin a sentence (the work recognizer 16 recognizes the onset of a first word), it lists all possible first words of the sentence, as illustrated in FIG. 8A. After speaking the first word, the CRT displays the word detected and lists all possible second words, as illustrated in FIG. 8B. This proceeds to the end of the sentence, at which time the data is assembled for transmission over the extremely narrowband communications channel. At any time the speaker can see what next words will be expected. The computer 20 monitors the accuracy of the word matches. If any word falls below an adaptive threshold the synthesizer board 22 will repeat the sentence asking for verification before execution. If all words were recognized very clearly, the synthesizer board 22 will echo the sentence on completion while the computer is sending the message.

As each spoken work is exercised it is moved into storage in the computer 20 where the entire message is coded into a digital signal for a minimum or a near minimum number of bits. The words can be stored in the coded form to reduce the amount of storage required. Since the system contains a predetermined number of words which it can recognize, i.e. a predetermined number of word models, the coding may consist of a specific number for each of the words. Using the example of FIG. 8, the words "shift focus" might have a number 12, the word "south" might have the number 18, the number "2" might be represented by the number 21, etc. Since these words will be represented by the same numbers in the remote terminal 12, the personal computer 20 converts these numbers to a digital signal and transmits the signal to the remote terminal 12 where the digital signal is converted back to numbers and then back to words.

A second method of coding, which is utilized in the present embodiment, is to convert each letter of each word to the ASCII code. This coding method has some advantages, even though it requires a few more bits per word. One of the advantages is that the transmitted signal can be transmitted directly to most of the present day electrically operated printing devices. In the ASCII code, each letter is represented by 8 bits. Thus, if the sample message of FIG. 8 is "shift focus south 22 miles", the number of bits required to transmit this message in ASCII code is 260. If approximately 20 bits are utilized to describe properties of the speaker's voice, and synchronization, error correction and overhead signals require approximately another 30 bits, the entire message is approximately 310 bits long. Thus, it is possible to transmit a message approximately 4 seconds long with 310 bits or approximately 77 bits per second.

As mentioned above, if the coding system is utilized wherein each word has a specific number the following rational applies. Assuming the spoken message is 1 of 100 possible message types, all of equal probability, 7 bits are required to describe the message grammatical structure. If there are 200 optional words stored in the system, which may be selected to fill various positions in the message, then 8 bits will define which word was utilized in each optional position in the message. For the sample message utilized above ("shift focus south 22 miles"), 7 bits define the message syntax, 40 bits define the 5 optional words at places within the message where one of several words may be chosen and approximately 20 bits may describe properties of the speakers voice, for a total of 67 bits. Again assuming approximately 30 bits for synchronization, error correction and overhead signals, the total message is approximately 97 bits or about 25 bits per second.

The synthesizer board 22 in this specific embodiment is a commercially available item sold under the identifying title Microvox synthesizer by Micromint Inc. It will of course be understood by those skilled in the art that the LPC analyzer board 15 includes a synthesizer (see FIG. 2) and is utilized in place of the synthesizer board 22 when speaker recognition is included in the system and it is desired that the synthesized voice sound like the voice of the original speaker. However, the synthesizer board 22 is described herein because of its simplicity and ease of understanding. From the description of the synthesizer board 22 those skilled in the art will obtain a complete understanding of the operation of the synthesizer incorporated in the LPC analyzer board 15. A more complete description of the synthesizer included in the LPC analyzer board 15 can be obtained from the above-identified patent application and from a U.S. patent application entitled "Speech Synthesizer With Smooth Linear Interpolation", Ser. No. 267,203, filed May 26, 1981.

The synthesizer board 22 is a stand alone intelligent microprocessor that converts ASCII text to spoken English. It consists of an M6502 microprocessor 55, a 9600BPS UART 57 for serial interface, a random access memory (RAM) 59 having 2K bits of memory, an erasable programmable read only memory (EPROM) 61 having 8K bits, and SC01 Votrax voice synthesizer 63, a clock and programmable divider 65 and various buffers, controls and amplifiers. The synthesizer board 22 uses an algorithm which parses serial input data into words, then uses pronounciation rules of English to generate a phoneme stream from the spelling. This phoneme stream then controls the speech synthesizer 63. The speech synthesizer 63 contains a read only memory which models phonemes as a sequence of one to four steady state sounds of specified duration and spectrum. The operation of the synthesizer board 22 is based on the letter to phoneme rules, which are implemented in the microprocessor 55 and phonemic speech synthesis in the speech synthesizer 63. The microprocessor 55 reads up to 1500 characters into its internal page buffer from the serial interface port 57. It then identifies phase groups by their punctuation and words by their space delimiters. It uses the phrase group boundaries to apply appropriate declarative or interrogative pitch and duration inflection to the phrase. A word at a time, each character is scanned from left to right across the word. When a character is found where the left and right context requirements (adjacent characters) are satisfied, the first applicable rule for that character is applied to translate it to a phoneme.

The speech synthesizer 63 is a CMOS chip which consists of a digital code translator and an electronic model of the vocal track. Internally, there is a phoneme controller which translates a 6 bit phoneme and 2 bit pitch code into a matrix of spectral parameters which adjusts the vocal track model to synthesize speech. The output pitch of the phonemes is controlled by the frequency of the clock signal from the clock and divider 65. Subtle variations of pitch can be induced to add inflection, which prevents the synthesized voice from sounding to monotonous or robot like. While the present algorithm converts English text to speech, it is understood by those skilled in the art that text to speech algorithms can be written for other languages as well. 64 phonemes define the English language and each phoneme is represented by a 6 bit code which is transmitted from the microprocessor 55 to the voice synthesizer 63. The phoneme controller then translates the bits to the spectral parameters mentioned above.

In order to make the synthetic speech sound very much like the identified original speaker, various codes may be transmitted from the sending end to the receiving end, that convey speaker specific pronunciation data about these words. This may be accomplished by simply sending a speaker identification code which the receiver may use to look up vocal tract length and average pitch range. Alternatively the transmitter may send polynomial coefficients which describe the pitch contour over the length of the sentence, and a vocal track length modifier. These polynomial coefficients allow the proper pitch range, pitch declination, and emphasis to be transmitted with very few bits. The vocal track length modifier will allow the synthesizer to perform polynomial interpolation of the LPC reflection coefficients to make the vocal tract longer or shorter than that of the stored model used by the letter to sound rules.

Thus, an extremely narrowband communications system is disclosed wherein each terminal converts human voice to digital signals having a rate of less then 300 bits per second. Further, the terminal has the capability of receiving digital signals representative of a human voice and synthesizing the human voice with the same properties as the original speaker. In addition, each terminal has the capabilities of recognizing words and the specific speaker with a very high accuracy.

While I have shown and described a specific embodiment of this invention, further modifications and improvements will occur to those skilled in the art. I desire it to be understood, therefore, that this invention is not limited to the particular form shown and I intend in the appended claims to cover all modifications which do not depart from the spirit and scope of this invention.

What is claimed is:

1. A method of extremely narrowband communication comprising the steps of:

converting human speech to electrical signals;

analyzing the electrical signals to provide a plurality of signals representative of a plurality of properties which characterize a human voice;

storing signals representative of a plurality of spoken words;

comparing at least some of the plurality of signals to the stored signals to determine specific words in the human speech and supplying signals representative of the specific words; and converting the supplied signals representative of specific words to a digital form having a rate of less than 300 bits per second.

2. A method as claimed in claim 1 including the step of recognizing the beginning and the end of each spoken word prior to the step of comparing.

3. A method as claimed in claim 2 including in the storing step, storing signals representative of a plurality of words spoken by a plurality of different individuals and further including in the comparing step the supplying of signals representative of the individual speaking the specific words.

4. A method as claimed in claim 2 including the steps of storing a plurality of predetermined messages and indicating to the speaker a list of possible next words subsequent to the recognition of the end of a word.

5. A method as claimed in claim 3 including in addition the steps of formatting the human speech, after conversion to digital form, into a digital electrical signal containing a plurality of bits representative of the message and a plurality of bits representative of characteristic properties of the human voice and transmitting the digital electrical signal to a remote terminal.

6. A method as claimed in claim 5 including the steps of receiving a digital electrical signal transmitted from a remote terminal and coverting the received signal to a spoken message in a synthesized voice having approximately the characteristic properties of an original speaker at the remote terminal.

* * * * *